United States Patent [19]

Riggs

[11] Patent Number: 4,476,927

[45] Date of Patent: Oct. 16, 1984

[54] METHOD FOR CONTROLLING $H_2/CO$ RATIO OF IN-SITU COAL GASIFICATION PRODUCT GAS

[75] Inventor: James B. Riggs, Maidsville, W. Va.

[73] Assignee: Mobil Oil Corporation, New York, N.Y.

[21] Appl. No.: 364,148

[22] Filed: Mar. 31, 1982

[51] Int. Cl.[3] ..... E21B 43/24

[52] U.S. Cl. ..... 166/261; 166/272; 166/266; 166/267; 48/DIG. 6

[58] Field of Search ..... 166/251, 256, 259, 261, 166/266, 267, 270, 271, 272; 299/2, 3; 48/202, 204, 210, DIG. 6

[56] References Cited

U.S. PATENT DOCUMENTS

| | | | |
|---|---|---|---|
| 3,770,398 | 11/1973 | Abraham et al. | 166/261 |
| 3,892,270 | 7/1975 | Lindquist | 166/261 |
| 4,197,911 | 4/1980 | Anada | 166/261 |
| 4,250,230 | 2/1981 | Terry | 166/261 |

*Primary Examiner*—Stephen J. Novosad
*Assistant Examiner*—William P. Neuder
*Attorney, Agent, or Firm*—Alexander J. McKillop; Michael G. Gilman; Charles J. Speciale

[57] ABSTRACT

A method for in-situ coal gasification to recover a product gas having a predetermined $H_2/CO$ ratio by introducing controlled amounts of carbon dioxide recovered from the product gas along with steam and oxygen injected into the coal deposits. The $H_2/CO$ ratio of the product gas is preferably maintained within the range of 1.5 to 4.0.

1 Claim, 1 Drawing Figure

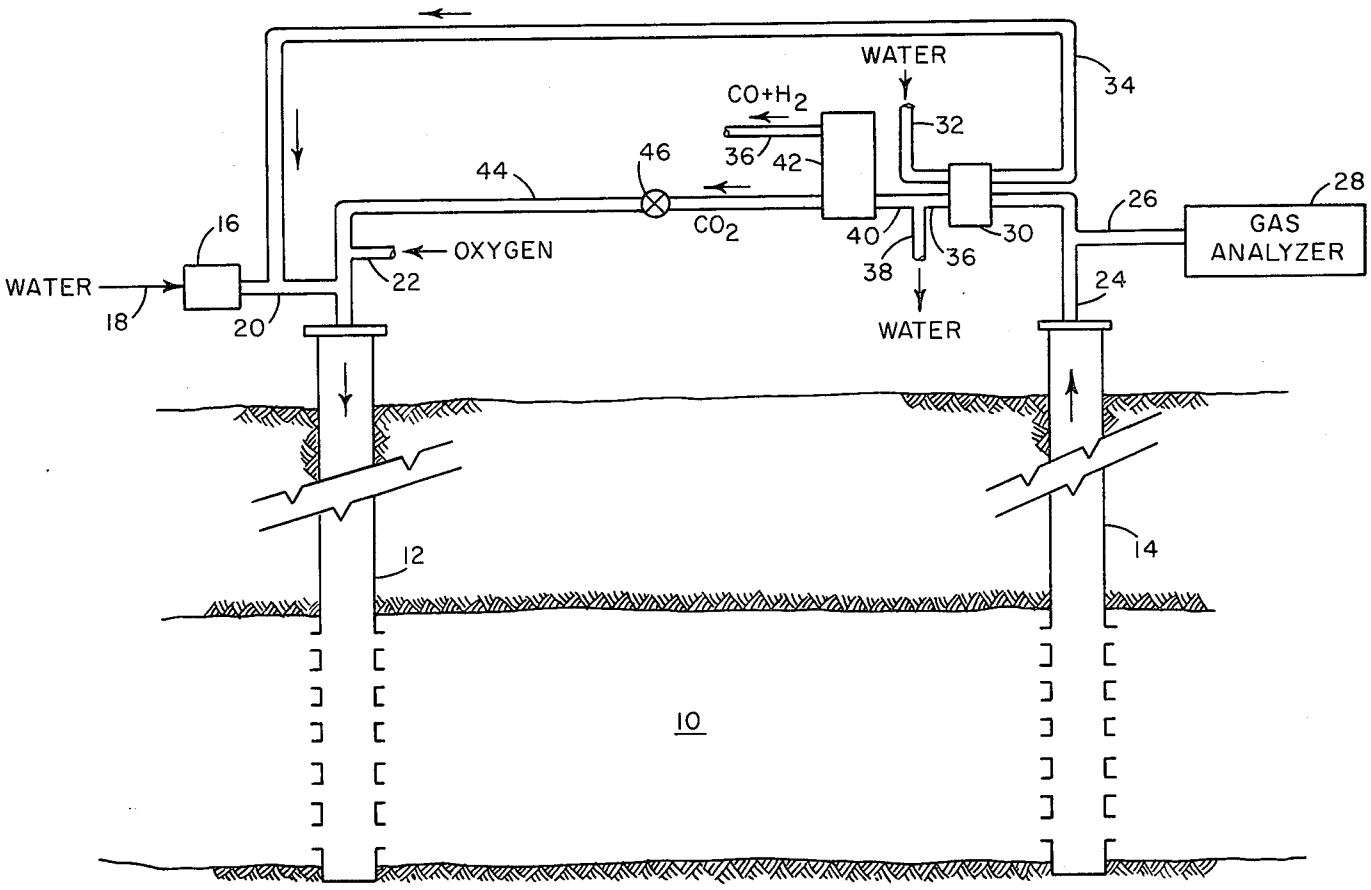
GAS ANALYZER
28
26
34
24
14
30
36
WATER
32
WATER
40
38
42
CO+H2
36
CO2
46
10
44
OXYGEN
22
12
20
16
18
WATER

METHOD FOR CONTROLLING $H_2/CO$ RATIO OF IN-SITU COAL GASIFICATION PRODUCT GAS

FIELD AND BACKGROUND OF THE INVENTOR

1. Field of the Invention

This invention relates to the in-situ gasification of a subterraneous coal deposit for the recovery of a product gas having a predetermined $H_2/CO$ ratio. More particularly, the present invention is a method for producing a product gas by in-situ gasification of coal wherein carbon dioxide recovered from the product gas is recycled into the coal deposit with steam and oxygen to control the $H_2/CO$ ratio of the product gas to a predetermined valve.

2. Background of the Invention

In-situ gasification of a subterranean coal deposit is a useful method for the in-situ extraction of coal value. In its most general form, a pair of process wells (an injector and a producer) some specified distance apart, is drilled from the surface into the coal deposit. Although a coal deposit contains an appreciable amount of natural cracks and fissures, its overall permeability is quite low. Therefore, prior to initiation of in-situ gasification, fluid communication passages must be established in the coal deposit between the two wells. Fluid communication passages may be established by various means such as directional drilling, hydraulic, or explosive fracturing, reverse combustion, etc. Thereafter, a mixture of steam and an oxidant such as air, oxygen-enriched air or essentially pure oxygen is introduced into the coal deposit via the injection well to initiate an oxidation reaction that forms a product gas containing carbon monoxide, hydrogen, and carbon dioxide that is recovered through the production well.

The product gas recovered in which hydrogen and carbon monoxide are the principal ingredients is useful as a feed stock for various Fischer-Tropsche synthesis processes. In these processes, the $H_2/CO$ ratio of the feed gas is critical to the efficiency of the particular process. For example, in the conversion of synthesis gas comprising hydrogen and carbon monoxide to methanol, the optimum $H_2/CO$ ratio is 2.0.

The present invention provides a method by which the $H_2/CO$ ratio of the product gas produced by in-situ coal gasification can be controlled.

SUMMARY OF THE INVENTION

The objects of the present invention are attained by first initiating an in-situ gasification process in a subterraneous coal deposit by introducing a mixture of oxygen and steam into the coal deposit and recovering product gas containing carbon monoxide, hydrogen, and carbon dioxide. Carbon dioxide is separated from the product gas and is recycled to the injection well where it is mixed with injected steam and oxygen. The amount of carbon dioxide introduced into the coal deposit with the steam and oxygen is controlled so that the oxidation reaction with the coal forms a product gas having a predetermined $H_2/CO$ ratio, preferably 1.5 to 4.0. The product gas having the desired $H_2/CO$ ratio is recovered and used as a feed gas for various Fischer-Tropsche synthesis processes where an optimum $H_2/CO$ ratio is desired.

BRIEF DESCRIPTION OF THE DRAWING

The attached drawing depicts a subterranean coal deposit being subjected to in-situ gasification in combination with surface treating facilities utilized in practicing the process of the present invention.

DESCRIPTION OF THE PREFERRED EMBODIMENTS

This invention relates to a method for the in-situ gasification of coal in a subterranean coal deposit to recover a product gas having a predetermined hydrogen/carbon monoxide ratio, preferably 1.5 to 4.0.

The process of any invention may be best understood by referring to the attached drawing, in which a coal deposit 10 is penetrated by an injection well 12 and a production well 14, both wells being completed throughout the entire thickness of the coal seam. A steam generator 16 supplied by boiler fuel quality water 18 has its output 20 connected to injection well 12. Oxygen is supplied to injection well 12 through line 22.

Initially, it may be necessary to fracture the coal deposit to establish fluid communication passages between 12 and 14. The means for fracturing the coal seam 10 may comprise various means such as hydraulic fracturing, explosives, etc.

Oxygen is injected into injection well 12 via line 22 and the coal adjacent the well is ignited by suitable means such as an electric heater (not shown) positioned in the well adjacent the perforations establishing communication with the coal seam 10. Once combustion has been initiated, steam is injected into injection well 12 via line 20 and is mixed with the oxygen from line 22.

The product gas formed by the oxidation reaction in the coal seam is withdrawn from the coal seam through production well 14. In general, the product gas consists principally of steam, carbon monoxide, carbon dioxide, and hydrogen.

The produced gas formed by the gasification of the coal is generally described by the following set of general reactions:

$$\text{Coal} + nO_2 \rightarrow mCO_2 + 1H_2O \quad (1)$$

where: n, m, and 1 are stoichiometric coefficients which will vary depending upon the rank of the coal being gasified and combustion conditions;

$$\text{Coal} \rightarrow \text{dried coal} + H_2O \quad (2)$$

$$\text{dried coal} \rightarrow \text{pyrolysis gases} + \text{char} \quad (3)$$

$$C + H_2O \rightarrow H_2 + CO \quad (4)$$

A still further reaction occurs in the gas phase between carbon monoxide and water known as the water-gas shift reaction which is represented by the following equation:

$$CO + H_2O \rightleftharpoons CO_2 + H_2 \quad (5)$$

By increasing the amount of carbon dioxide in the product gas, the water-gas shift reaction (5) can be shifted back toward carbon monoxide and water so that the formation of carbon monoxide is increased, thereby reducing the ratio of the $H_2/CO$. Decreasing the amount of $CO_2$ will decrease the formation of carbon monoxide thereby increasing the ratio of $H_2/CO$. Increasing the amount of $CO_2$ will increase the formation of carbon monoxide thereby decreasing the $H_2/CO$ ratio. This can be accomplished by injecting carbon dioxide into the injection well 12 along with the oxygen and steam. Therefore, by controlling the amount of carbon dioxide injected into well 12, the ratio of $H_2/CO$ in the product gas can be controlled within a desired value, preferably 1.5 to 4.0.

The carbon dioxide injected to control the ratio of $H_2/CO$ in the product gas is recovered from the product gas and recycled to the injection well 12. Referring to the drawing, product gas is removed from production well 14 through line 24. A small portion of the product gas is removed from line 24 through line 26 and delivered to gas analyzer 28 for determining the ratio of hydrogen to carbon monoxide. The product gas then passes through heat 24 into line exchanger 30 into which water, via line 32, is introduced concurrently so as to subject the produced gas to a heat scavenging means for the generation of at least a portion of the steam used in the process. The steam generated by heat exchanger 30 is transported via line 34 back to injection well 12. The cooled product gas containing condensed water is withdrawn from the heat exchanger via line 36 and the condensed water is withdrawn through line 38. The produced gas then passes through line 40 to a carbon dioxide absorption unit 42 wherein the carbon dioxide is absorbed from the product gas by a solvent such as water, methanol, monoethanolamine, or a light hydrocarbon. The carbon dioxide is recovered from the solvent and transported via line 44 to be mixed with the injected oxygen from line 22 and steam from line 20 and the mixture of carbon dioxide, steam, and oxygen is introduced into the coal seam via injection well 12. The amount of recycled carbon dioxide injected is controlled by control valve 46 to obtain the desired $H_2/CO$ ratio of 1.5 to 4.0 in the product gas as determined by gas analyzer 28. A process computer (not shown) is connected to receive input from the gas analysis and programmed to regulate the flow of carbon dioxide recycled to the injection well 12 via line 44 to maintain the $H_2/CO$ ratio in the product gas to the predetermined value. The product gas, consisting of hydrogen and carbon monoxide, having the desired ratio, preferably 1.5 to 4.0, is withdrawn from the absorption unit 42 via line 36 and transported to a storage system for use as a feed gas in Fischer-Tropsche synthesis processes where an optimum $H_2/CO$ ratio is desired.

EXAMPLE

The process of the invention may be further illustrated by referring to the following example in which carbon dioxide is reinjected into the coal deposit to control the $H_2/CO$ ratio of the product gas. Assuming an in-situ combustion operation utilizing injection of a mixture of 50% steam and 50% oxygen, the product gas analysis, assuming 1 pound moles of dry product gas, is shown in Table 1 wherein the gases produced are expressed in pound moles.

TABLE I

| | |
|---|---|
| $H_2O$ | 1.3 |
| $H_2$ | 0.38 |
| CO | 0.11 |
| $CO_2$ | 0.45 |

The $H_2/CO$ ratio in the above product gas is 3.45.

The water-shift reaction is presented below:

$$CO + H_2O \rightleftharpoons CO_2 + H_2 \quad (5)$$

Assuming that reaction (5) is in equilibrium, the equilibrium constant Keq. can be calculated in accordance with the following equation:

$$Keq. = \frac{(CO_2)(H_2)}{(CO)(H_2O)} = \frac{(.45)(.38)}{(1.3)(.11)} = 1.2$$

Assuming that the steam in the injected combustion supporting gas is replaced with carbon dioxide, then 0.33 pound mole of carbon dioxide would be added since 25% of the water in the product gas is the result of injected steam. If x equals the change in the water-gas shift reaction and assuming equilibrium, then the product gas analysis in pound moles would be as follows:

| | |
|---|---|
| $H_2O$ | 1.3 − .33 + x |
| CO | .11 + x |
| $CO_2$ | .45 + .33 − x |
| $H_2$ | .38 − x |

Substituting these values into equation (1) for an equilibrium constant Keq. of 1.2, x is calculated to be 0.0682 and the product gas now contains 0.312 pound mole of hydrogen and 0.178 pound mole of carbon dioxide providing a $H_2/CO$ ratio of 1.75.

While the invention has been described in terms of a single injection well and a single spaced apart production well, the method according to the invention may be practiced using a variety of well patterns. Any other number of wells, which may be arranged according to any pattern, may be applied in using the present method as illustrated in U.S. Pat. No. 3,927,716 to Burdyn et al.

From the foregoing specification one skilled in the art can readily ascertain the essential features of this invention and without departing from the spirit and scope thereof can adapt it to various diverse applications. It is my intention and desire that my invention be limited only by those restrictions or limitations as are contained in the claims appended immediately hereinafter below.

What is claimed is:

1. A method for the in-situ recovery of a synthetic product gas from a subterranean coal deposit penetrated by at least one injection well and at least one spaced-apart production well, said well's being in fluid communication with a substantial portion of the coal deposit, comprising the steps of:

a. establishing fluid communication passages in the coal deposit between said injection well and said production well;

b. injecting oxygen and steam into said coal seam via said injection well to react with said coal and form a product gas containing carbon dioxide, hydrogen, and carbon monoxide;

c. producing said product gas through said production well;

d. analyzing said product gas to determine the ratio of $H_2/CO$;

e. separating carbon dioxide from said product gas;

f. mixing said carbon dioxide recovered from said product gas with the oxygen and steam injected into the coal deposit via said injection well;

g. controlling the amount of carbon dioxide injected into the coal deposit so that the oxidation reactions therein form a product gas having a predetermined $H_2/CO$ ratio within the range of 1.5 to 4.0; and h. recovering the product gas having a predetermined $H_2/CO$ ratio.

* * * * *